US007633226B2

(12) United States Patent
Michael et al.

(10) Patent No.: US 7,633,226 B2
(45) Date of Patent: Dec. 15, 2009

(54) ELECTRODE MATERIALS FOR ELECTRIC LAMPS AND METHODS OF MANUFACTURE THEREOF

(75) Inventors: Joseph Darryl Michael, Schoharie, NY (US); John Anthony DeLuca, Burnt Hills, NY (US)

(73) Assignee: General Electric Company, Niskayuna, NY (US)

( * ) Notice: Subject to any disclaimer, the term of this patent is extended or adjusted under 35 U.S.C. 154(b) by 575 days.

(21) Appl. No.: 11/289,955

(22) Filed: Nov. 30, 2005

(65) Prior Publication Data

US 2007/0120482 A1 May 31, 2007

(51) Int. Cl.
*H01J 17/20* (2006.01)
*H01J 61/12* (2006.01)

(52) U.S. Cl. ..... 313/568; 313/491; 313/572; 313/631; 313/637

(58) Field of Classification Search ..... 313/484, 313/491, 568, 572, 574, 631, 637–643
See application file for complete search history.

(56) References Cited

U.S. PATENT DOCUMENTS

| | | | | |
|---|---|---|---|---|
| 1,663,553 | A | 3/1928 | Eredell | |
| 3,708,710 | A | 1/1973 | Smyser et al. | |
| 4,171,498 | A * | 10/1979 | Fromm et al. | 313/641 |
| 4,232,243 | A * | 11/1980 | Rigden | 313/623 |
| 4,303,848 | A | 12/1981 | Shimizu et al. | |
| 4,319,158 | A | 3/1982 | Watanabe et al. | |
| 4,574,219 | A * | 3/1986 | Davenport et al. | 315/49 |
| 5,138,224 | A * | 8/1992 | Goldburt et al. | 313/491 |
| 5,550,431 | A | 8/1996 | Duggan et al. | |
| 5,712,531 | A * | 1/1998 | Rademacher et al. | 313/631 |
| 5,880,558 | A | 3/1999 | Bauer | |
| 5,982,088 | A | 11/1999 | Hamada et al. | |
| 6,211,615 | B1 * | 4/2001 | Altmann et al. | 313/631 |
| 6,281,626 | B1 * | 8/2001 | Nakamura et al. | 313/491 |
| 6,432,325 | B1 | 8/2002 | Hamada et al. | |
| 6,628,082 | B2 * | 9/2003 | Ogata et al. | 315/58 |
| 6,674,240 | B1 | 1/2004 | Gärtner et al. | |

(Continued)

FOREIGN PATENT DOCUMENTS

EP 0643416 A1 3/1994

(Continued)

OTHER PUBLICATIONS

PCT International Search Report dated Feb. 25, 2008.

*Primary Examiner*—Toan Ton
*Assistant Examiner*—Kevin Quarterman
(74) *Attorney, Agent, or Firm*—Mary Louise Gioeni

(57) ABSTRACT

An electron emissive material includes a composition including a metal oxide, where the metal oxide is at least one oxide of La, Ce, Pr, Nd, Pm, Sm, Eu, Gd, Tb, Dy, Ho, Er, Tm, Yb, Lu, Y, Sc, Hf, or Zr, or any combinations thereof, where the metal oxide is present in a quantity that ranges from about 20% to 100% by weight of the total composition, where the composition is operable to emit electrons in a discharge medium in response to a thermal excitation, wherein the discharge medium under steady state operating conditions producing a total vapor pressure of less than about $2\times10^5$ Pa. A lamp including an envelope, an electrode including an electron emissive material and a discharge medium, is also disclosed.

18 Claims, 10 Drawing Sheets

U.S. PATENT DOCUMENTS

| | | | | |
|---|---|---|---|---|
| 6,680,574 | B1 * | 1/2004 | Gaertner et al. | 313/633 |
| 6,815,889 | B2 * | 11/2004 | Haacke et al. | 313/573 |
| 2002/0024280 | A1 | 2/2002 | Miyamoto et al. | |
| 2004/0169476 | A1 * | 9/2004 | Ehrlichmann et al. | 313/630 |
| 2007/0120456 | A1 * | 5/2007 | Sommerer | 313/311 |

FOREIGN PATENT DOCUMENTS

| | | | |
|---|---|---|---|
| EP | 0982758 | A2 | 3/2000 |
| EP | 0783763 | B1 | 5/2000 |
| JP | 57194447 | | 11/1982 |
| JP | 2000133200 | | 5/2000 |
| WO | WO 2004/008483 | A1 | 1/2004 |
| WO | WO 2004/025692 | A1 | 3/2004 |

* cited by examiner

ELECTRODE MATERIALS FOR ELECTRIC LAMPS AND METHODS OF MANUFACTURE THEREOF

BACKGROUND

Embodiments of the invention relate generally to electron emissive materials and in particular to electrode materials for electric lamps.

Low-pressure metal halide electric discharge plasmas have the potential to replace mercury-based electric discharge plasma used in conventional fluorescent lamps. However, most known electron emission materials in conventional lamps are not chemically stable in the presence of metal halide plasma. Electron-emissive mixtures containing barium oxide have been typically used in mercury discharge lamps. However, the use of barium oxide in metal halide discharge lamps poses certain challenges. The use of barium oxide as a component of lamp electrodes, especially in low-pressure metal halide discharge lamps, is expected to lead to performance issues. This is at least in part due to the reaction of the metal halide with barium oxide, which can lead to the formation of barium halide and a condensed metal oxide. For example, a metal halide discharge medium such as indium bromide may react with an electrode material such as barium oxide to form barium bromide and indium oxide. Such a reaction would lead to a direct reduction in light emitting discharge medium present in the discharge plasma. It would therefore be advantageous to avoid such deleterious reactions in discharge lamps, especially involving the metal halide discharge medium, as it may lead to a reduction in the life of the lamp.

BRIEF DESCRIPTION

One aspect of the present invention includes a composition including a metal oxide where the metal oxide is selected from the group consisting of oxides of La, Ce, Pr, Nd, Pm, Sm, Eu, Gd, Tb, Dy, Ho, Er, Tm, Yb, Lu, Y, Sc, Hf, Zr, and combinations thereof, where the metal oxide is present in a quantity that ranges from about 20% to 100% by weight of the total composition, where the composition is operable to emit electrons in a discharge medium, where the discharge medium under steady state operating conditions producing a total vapor pressure of less than about $2\times10^5$ Pa.

Another aspect of the present invention includes an electrode including an electron emissive material, where the electron emissive material includes a composition including a metal oxide, where the metal oxide is selected from the group consisting of oxides of La, Ce, Pr, Nd, Pm, Sm, Eu, Gd, Tb, Dy, Ho, Er, Tm, Yb, Lu, Y, Sc, Hf, Zr, and combinations thereof, wherein the metal oxide is present in a quantity that ranges from about 20% to 100% by weight of the total composition of the electron emissive material, wherein said electron emissive material is operable to emit electrons in a discharge medium, the discharge medium under steady state operating conditions producing a total vapor pressure of less than about $2\times10^5$ Pa.

Yet another aspect of the present invention includes a lamp including an envelope, an electrode including an electron emissive material and a discharge medium.

A further aspect of the present invention includes a method of manufacturing an electron emissive system including the steps of providing an electrode substrate, providing an electron emissive material, disposing the electron emissive material over the substrate, and activating the electron emissive material.

In a still further aspect of the present invention includes a method of operating a lamp comprising thermally exciting an electron emissive material disposed within a lamp by operably coupling the lamp to an excitation source and supplying thermal energy to cause the electron emissive material to emit electrons.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
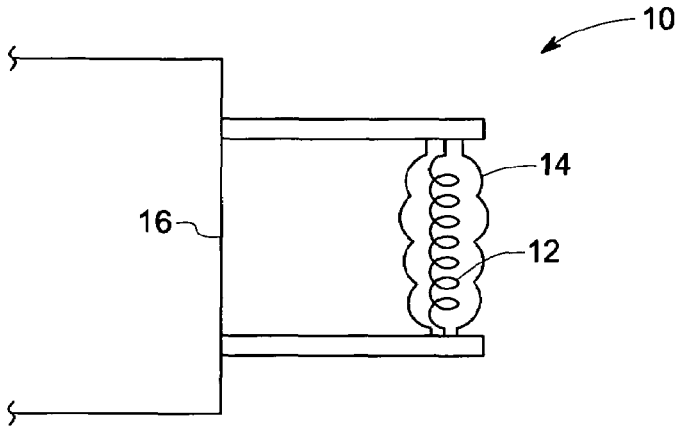
FIG. 1 is a side cross-sectional view of a coil electrode having an electron emissive material in accordance with certain embodiments of the present invention.

In accordance with one embodiment of the present invention, a composition including a metal oxide is described, wherein the composition is operable to emit electrons in response to a thermal excitation. As used herein, and throughout the following description, the term "metal oxide" refers to at least one oxide of La, Ce, Pr, Nd, Pm, Sm, Eu, Gd, Tb, Dy, Ho, Er, Tm, Yb, Lu, Y, Sc, Hf, and Zr, or combinations thereof. Moreover, as used herein and throughout the following description, the term "metal oxide composition" refers to a composition including a metal oxide, where the metal oxide composition is operable to emit electrons in response to a thermal excitation. The metal oxide may be present in the metal oxide composition in a quantity that ranges from about 20% to 100% by weight of the total metal oxide composition, where the metal oxide composition is operable in a discharge medium, and where the discharge medium under steady state operating conditions produces a total vapor pressure of less than about $2\times10^5$ Pa. In a further embodiment, the discharge medium under steady state operating conditions may produce a total vapor pressure of less than about $2\times10^4$ Pa.

As used herein and throughout the following description, "M" refers to at least one of La, Ce, Pr, Nd, Pm, Sm, Eu, Gd, Tb, Dy, Ho, Er, Tm, Yb, Lu, Y, Sc, Hf, and Zr, or combinations thereof. In some embodiments of the present invention, a metal oxide has a formula $MO_2$. Non-limiting examples of such metal oxides include hafnium oxide ($HfO_2$) and zirconium oxide ($ZrO_2$). In other embodiments of the present invention, a metal oxide has a formula $M_2O_3$. Examples of such metal oxides include but are not limited to dysprosium oxide ($Dy_2O_3$), neodymium oxide ($Nd_2O_3$), lutetium oxide ($Lu_2O_3$), and terbium oxide ($Tb_2O_3$).

In one embodiment of the present invention, electrical conductivity of a metal oxide composition may be enhanced by imperfections, such as but not limited to lattice vacancies, in the metal oxide composition. In some embodiments, a metal oxide composition may be charge balanced (also referred to herein as being "stoichiometric"). Charge balancing results in no net charge on the metal oxide composition. In other embodiments, a metal oxide composition may be non-stoichiometric. For example, a metal oxide composition may have some oxygen deficiency, such that excess metal present in the metal oxide composition may act as dopants and lead to increased electrical conductivity.

In some embodiments of the present invention, a metal oxide may be present in a metal oxide composition in a quantity greater that 30% by weight of the total metal oxide composition. In other embodiments a metal oxide may be present in a metal oxide composition in a quantity greater than 50% by weight of the total metal oxide composition. In still further embodiments, a metal oxide may be present in a metal oxide composition in a quantity greater than 70% by weight of the total metal oxide composition.

In accordance with some embodiments of the present invention, a metal oxide composition is provided that includes a metal oxide such as neodymium oxide, terbium oxide, or lutetium oxide or combinations thereof that is operable to emit electrons in response to a thermal or electrical excitation. The metal oxide composition is operable in a discharge medium, under varied discharge medium pressure conditions. In one embodiment, the discharge medium under steady state operating conditions, may produce a total vapor pressure of less than about $2\times10^5$ Pa. In other embodiments, the discharge medium under steady state operating conditions may produce a total vapor pressure of less than about $2\times10^4$ Pa. In other embodiments, the discharge medium under steady state operating conditions may produce a total vapor pressure of less than about $2\times10^3$ Pa. In one embodiment, the metal oxide may be present in quantity from about 0.01% to about 100% by weight of the total metal oxide composition.

In some embodiments, the metal oxide composition is a mixture, a solid solution, a compound, or any combination thereof of two or more metal oxides. In some further embodiments, the metal oxide composition is a solid solution of two or more metal oxides. For example, the metal oxide composition may be a solid solution of a first metal oxide and a second metal oxide, wherein the first and second metal oxides are different and the first and second metal oxides include at least one oxide of La, Ce, Pr, Nd, Pm, Sm, Eu, Gd, Tb, Dy, Ho, Er, Tm, Yb, Lu, Y, Sc, Hf, and Zr, or combinations thereof. In some embodiments, a weight percent ratio in the metal oxide composition of the first metal oxide to the second metal oxide may be in a range from about 90:10 to 10:90. In some other embodiments, a weight percent ratio in the metal oxide composition of the first metal oxide to the second metal oxide may be in a range from about 70:30 to about 30:70. In certain embodiments, a weight percent ratio in the metal oxide composition of the first metal oxide to the second metal oxide may be in a range from about 60:40 to about 40:60. The amount of various components in the solid solutions may be chosen to select a certain level of overall chemical activity, and specifically, vapor pressure of the substances in solution.

A metal oxide composition as provided in accordance with certain aspects of the present invention may be operable to emit electrons in response to a thermal excitation. Thermal excitation leading to thermionic emission is a process by which materials emit electrons or ions upon application of heat. The work function of a material may play a role in determining the level of electron emission for a given thermal excitation.

In a further embodiment, a metal oxide composition may be present in an electron emissive material as an electron emitter material in discharge devices such as lamps. The electron emissive materials described herein may emit electrons in response to various excitations such as, but not limited to, thermal excitation. As used herein and throughout the following description, the term "electron emissive material" refers to any material that includes a metal oxide composition.

In some embodiments, a metal oxide composition of the present invention may be present in a range from about 1% to about 100% by weight of the total electron emissive material. In other embodiments, a metal oxide composition may be present in a range from about 25% to about 75% by weight of the total electron emissive material. In certain other embodiments, a metal oxide may be present in a range from about 40% to about 60% by weight of the total electron emissive material.

In some embodiments of the present invention, an electron emissive material may be provided on the electrode in a number of ways including, for example, through a wet application. In one embodiment, the electron emissive material may be provided on a hot cathode electrode. During lamp operation, the hot cathode is heated to a temperature at which the electron emissive material by means of thermionic emission, provides electrons at levels necessary to support a discharge arc. Hot cathode electrodes may be used in "pre-heat" "rapid-start" and "instant start" lamp igniting configurations.

Typically in a preheat lamp igniting configuration, electrodes are heated to their emission temperature prior to ignition of the lamp by a pre-heat current. Typically a starting circuit in the lamp sends increased current through the electrodes to heat the filament electrodes. In one example, as the heater current is switched off, the lamp experiences a spike in voltage which may help ignite a discharge arc between the electrodes. The temperature necessary for free emission of electrons is maintained after ignition by incident ions from the discharge.

In a rapid start lamp igniting configuration, ballasts are used to ignite the lamps by simultaneously providing a cathode voltage (to provide heat) and an ignition voltage across the lamp. As the cathodes heat up, the voltage required to ignite the lamp is reduced. At some time after both voltages are applied, the cathodes reach a temperature sufficient for the applied voltage to ignite the lamp.

In an instant start lamp igniting configuration, an starting voltage many times greater than the lamp's normal operating voltage and greater than the lamp's break-down resistance is applied. The electric field due to the starting voltage is sometimes as high as 9 V/cm, high enough to break down the discharge medium to enable current conduction.

In some embodiments, an electron emissive material may further include metals or metal alloys. Examples of metals include but are not limited to tantalum, tungsten, thorium, titanium, nickel, platinum, vanadium, hafnium, neodymium, molybdenum, and zirconium. In some embodiments, the metal and metal alloys may be used as substrate materials. In certain other embodiments, the composition may be used along with a metal such as a refractory metal to form a sintered composite. Refractory metals are a class of metals resistant to heat, wear and corrosion and generally have melting points greater than 1800° C.

In a further embodiment of the present invention, an electron emissive material may include at least one additive material in addition to a metal oxide composition (such "additive materials" may also be referred to herein as an "electron emissive additive materials"). Additive materials, for example, may be used as part of the electron emissive material to enable higher operational temperatures, or to enhance electron emission or to increase stability of the material. In some embodiments, additive materials may themselves be electron emissive, however they need not be.

In yet another embodiment of the present invention, oxides, other than metal oxides, may be used as additive materials to an electron emissive material. Non-limiting examples of such oxides include, barium oxide, calcium oxide, strontium oxide, magnesium oxide, barium-calcium-strontium triple oxide, aluminum oxide, tungsten oxide, thorium oxide, zirconium oxide and zinc oxide. In one embodiment, the additive material is at least one of zirconium, calcium oxide, strontium oxide, and magnesium oxide. In a further embodiment, the electron emissive material is barium-free.

Various embodiments of electrodes are depicted in the FIGS. 2-6. These embodiments illustrate how electron emissive materials such as those described herein may be utilized in various cathode configurations. The applications of the electron emissive materials described herein are not intended to be limited to the depicted embodiments.

Figure 2:
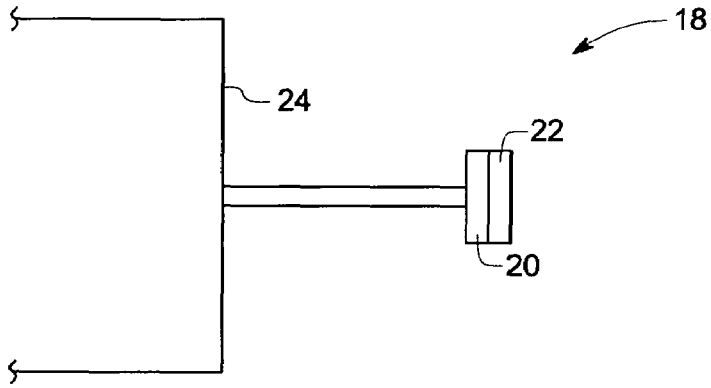
FIG. 2 is a side cross-sectional view of a flat member cathode having an electron emissive material in accordance with certain embodiments of the present invention.
Figure 3:
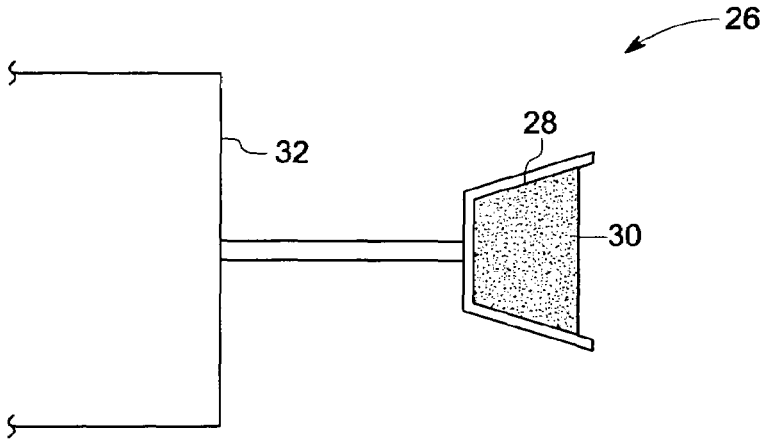
FIG. 3 is a side cross-sectional view of a cup shaped cathode having an electron emissive material in accordance with certain embodiments of the present invention.
Figure 4:
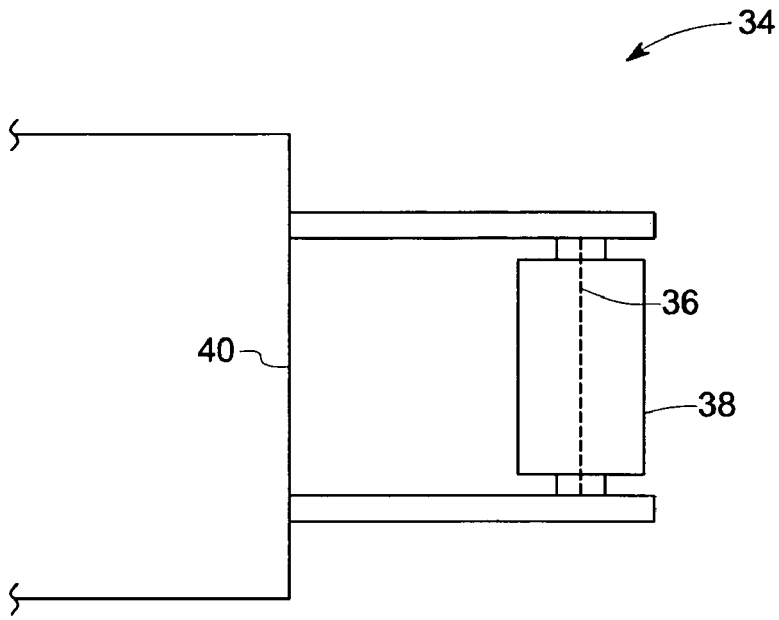
FIG. 4 is a side cross-sectional view of a cathode having an electron emissive material in accordance with certain embodiments of the present invention.

As illustrated in FIG. 2, the cathode 10 may comprise a metal wire or a metal coil 12, such as a tungsten coil, with an electron emissive material coating 14, coupled to a ballast 16. Ballasts are typically used to provide and regulate the necessary electric current to an electrode. Alternatively, as shown in FIG. 3, the cathode 18 may comprise a flat component 20 containing the electron emissive material 22 (such as in the form of a coating) on at least one surface coupled to a ballast 24. In the illustrated embodiment shown in FIG. 4, the cathode 26 includes a cup shaped structure 28 containing the electron emissive material 30 inside the hollow interior space of the cup. In some embodiments, the electron emissive material 30 may be operably coupled to the cup shaped structure 28 by sintering the cup 28 and the material 30 together. The cathode may be further coupled to a ballast 32.

Figure 5:
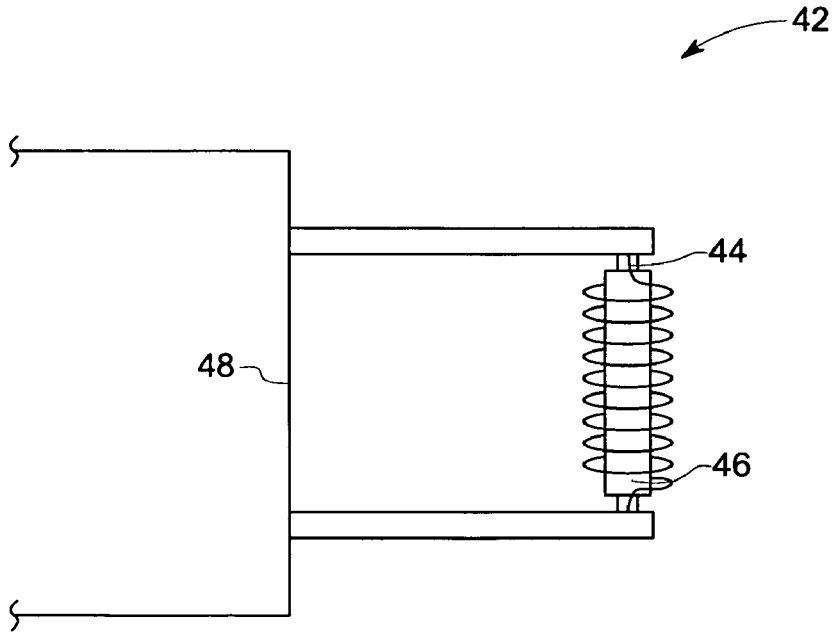
FIG. 5 is a side cross-sectional view of a cathode having an electron emissive material in accordance with certain embodiments of the present invention.
Figure 6:
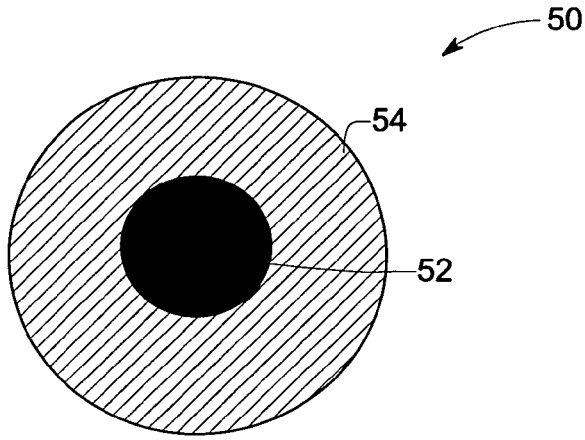
FIG. 6 is a cross-sectional view of an electron emissive material in accordance with certain embodiments of the present invention.

In the illustrated embodiment shown in FIG. 5, the cathode 34 includes a wire 36 such as a tungsten wire, disposed within a solid composite 38 including the electron emissive material 38. The cathode may be further coupled to a ballast 40. In the illustrated embodiment shown in FIG. 6, the cathode 42 may include a wire 44 such as a tungsten wire, coiled around a solid composite 46 including the electron emissive material 46. The cathode may be further coupled to a ballast 48.

Figure 7:
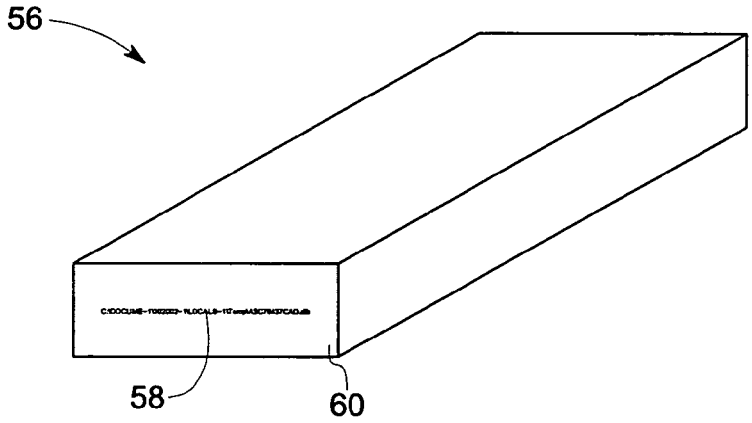
FIG. 7 is a side cross-sectional view of a coating including an electron emissive material in accordance with certain embodiments of the present invention.

Further, the electron emissive materials of the present invention may be utilized in different forms as shown in FIGS. 7-11. In some electrode embodiments, the electron emissive material may be present as particles 50 comprising a core material 52 and a shell material 54 as shown in FIG. 7. In a non-limiting example, the core material comprises a metal oxide composition. In another non-limiting example, the shell material comprises a metal oxide composition.

In other electrode embodiments, an electron emissive material may be disposed as a graded composite structure 56 of ceramic and metal as shown in the illustrated embodiment in FIG. 7. In a non-limiting example, the center 58 of the composite structure may be made with greater than 50% metal oxide concentration per unit volume and the outer edges 60 may be made with greater than 50% tungsten metal concentration per unit volume.

Figure 8:
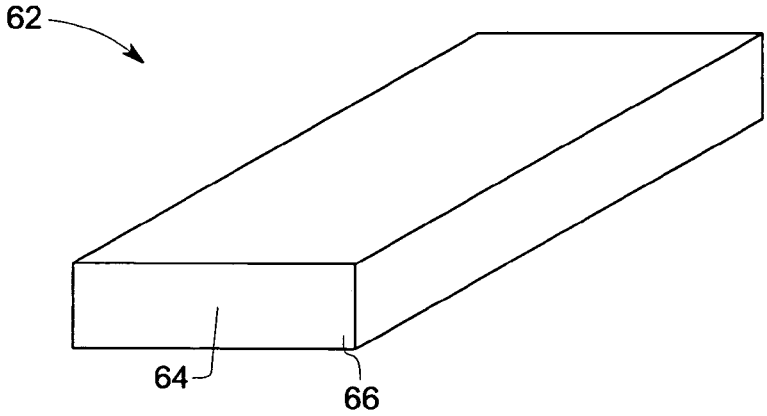
FIG. 8 is a side cross-sectional view of a coating including an electron emissive material in accordance with certain embodiments of the present invention.

In another embodiment, an electron emissive material may be disposed on an electrode as a graded sintered ceramic structure 62 as shown in FIG. 8. In a non-limiting example, concentration of the electron emissive material per unit volume of the sintered ceramic 62 increases radially from the outer edges 64 towards the core 66.

Figure 9:
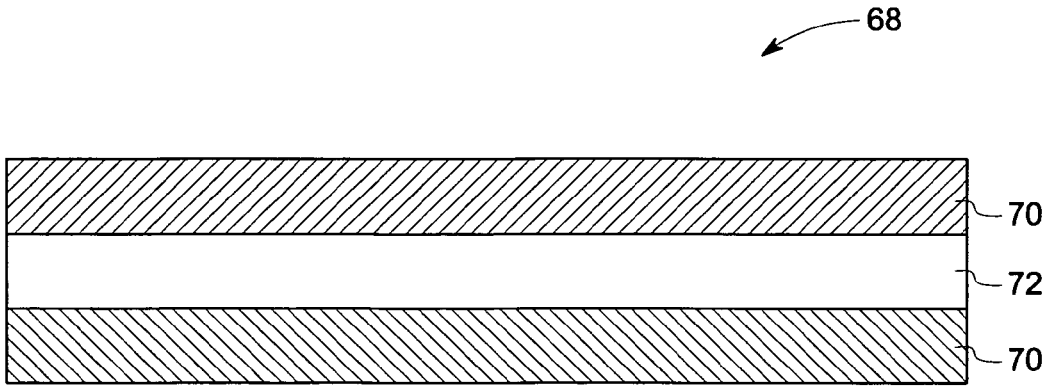
FIG. 9 is a cross-sectional view of an electron emissive material in accordance with certain embodiments of the present invention.

In still another embodiment of the present invention, an electrode 68 may comprise a multilayered structure as shown in FIG. 9. In a non-limiting example, a low metal oxide content layer 70 alternates with a high metal oxide content layer 72.

Figure 10:
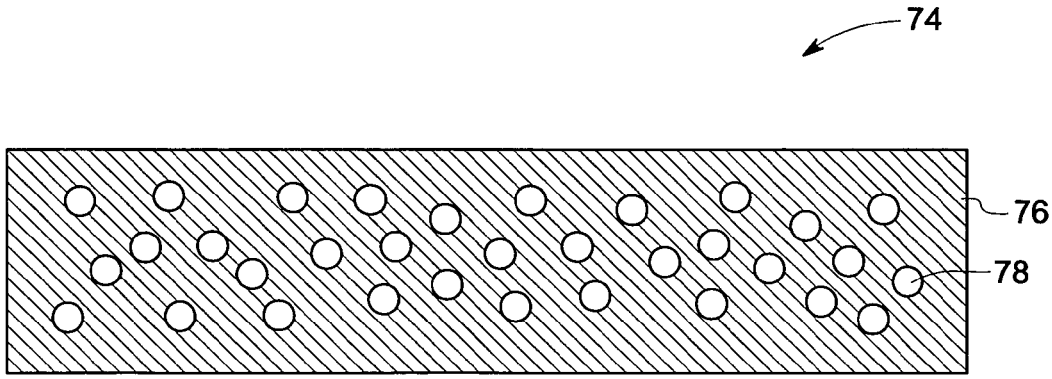
FIG. 10 is a side cross-sectional view of a linear fluorescent lamp employing an electron emissive material in accordance with embodiments of the present invention.
Figure 11:
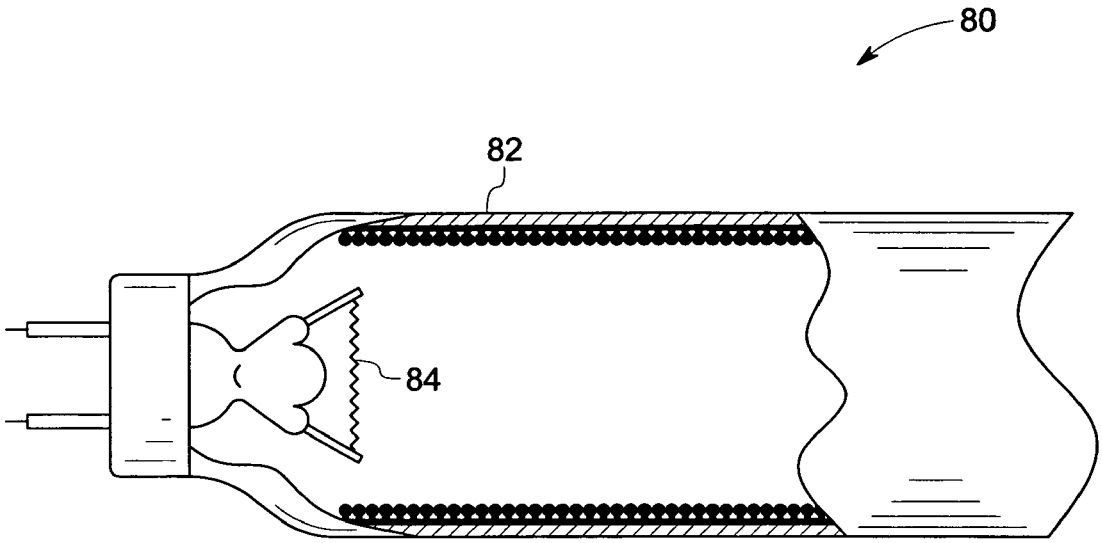
FIG. 11 is a side cross-sectional view of a compact fluorescent lamp employing an electron emissive material in accordance with embodiments of the present invention.

In yet another embodiment of the present invention as shown in FIG. 10, an electrode 74 may include an electron emissive material 76 embedded inside the pores of a porous refractory material 78. Refractory materials include but are not limited to tungsten and tantalum.

In one embodiment of the present invention, an electrode including an electron emissive material may be used in an electric plasma discharge device. Non-limiting examples of electric plasma discharge device include discharge lamps. In a further embodiment of the present invention, an electrode comprising an electron emissive material is disposed within a lamp having an envelope and a discharge medium disposed therein. Non-limiting examples of lamps suitable for use in accordance with teachings of the present invention include linear fluorescent lamps, compact fluorescent lamps, circular fluorescent lamps, high intensity discharge lamps, flat panel displays, mercury free lamps or xenon lamps.

Discharge lamps typically include an envelope containing a gas discharge medium through which a gas discharge takes place, and typically two metallic electrodes that are sealed in the envelope. While a first electrode supplies the electrons for the discharge, a second electrode provides the electrons with a path to the external current circuit. Electron emission generally takes place via thermionic emission, although it may alternatively be brought about via ion bombardment (ion-induced secondary emission).

A discharge medium may include discharge materials such as buffer gases and ionizable discharge compositions. Buffer gases may include materials such as but not limited to rare gases such as argon, neon, helium, krypton and xenon, whereas as ionizable discharge compositions may include materials such but not limited to metals and metal compounds. In some embodiments, ionizable discharge compositions may include rare gases. Non-limiting examples of discharge materials suitable for use in a lamp equipped with an electron emissive material including a metal oxide composition may include metals, such as but not limited to Hg, Na, Zn, Mn, Ni, Cu, Al, Ga, In, Tl, Sn, Pb, Bi, Ti, V, Cr, Zr, Nb, Mo, Hf, Ta, W, Re, or Os or any combinations thereof. Other discharge materials suitable for use in a lamp with an electron emissive material also include rare gases such as neon, argon, krypton, helium and xenon. Still other discharge materials include but are not limited to compounds such as halides or oxides or chalcogenides or hydroxide or hydride, or organometallic compounds or any combinations thereof of metals such as but not limited to Hg, Na, Zn, Mn, Ni, Cu, Al, Ga, In, Ti, Ge, Sn, Pb, Bi, Ti, V, Cr, Zr, Nb, Mo, Hf, Ta, W, Re, or Os or any combinations thereof. Non-limiting examples of metal compounds include zinc halides, gallium iodide, and indium iodide. In some embodiments, in metal halide discharge lamps, the metal and halogen may be present in a stoichiometric ratio. In some embodiments, in metal halide discharge lamps, the metal and halogen may be present in a stoichiometric ratio. In some other embodiments, the metal and halogen may be present in a non-stoichiometric ratio. In one embodiment, the discharge material in a lamp includes mercury. In another embodiment, the discharge material in a lamp is mercury free.

In some embodiments the discharge medium under steady-state operating conditions produces a total vapor pressure of less than about $2\times10^5$ pascals. As used herein, the term "steady state operating conditions" refers to operating conditions of a lamp which is in thermal equilibrium with its ambient surroundings, and wherein a majority of radiation from the discharge comes from the ionizable discharge compositions. Typically, the buffer gas pressure during steady-state operation is slightly higher than it was when then lamp was at ambient temperature. Typically, ionizable discharge composition pressure during steady state operation is orders of magnitude higher than it was when the lamp was at ambient temperature, as the vapor pressure depends exponentially on the temperature. In some embodiments, the discharge medium under steady-state operating conditions produces a total vapor pressure in a range from about 20 pascals to about $2\times10^4$ pascals. In some other embodiments, the discharge medium under steady-state operating conditions produces a total vapor pressure in a range from about 20 pascals to about $2\times10^3$ pascals. In some embodiments the discharge medium under steady-state operating conditions produces a total vapor pressure in a range of about $1\times10^3$ pascals. In some embodiments, the partial pressure under steady state operating conditions of the ionizable discharge composition in the discharge medium is less than about $1\times10^3$ pascals. In further embodiments, the partial pressure under steady state operating conditions of the ionizable discharge composition in the discharge medium is in a range from about $1\times10^{-1}$ pascals to about 10 pascals. In a non-limiting example, the discharge medium includes argon buffer gas and gallium iodide ionizable discharge composition. At an ambient temperature of 20° C., the total pressure is about $1\times10^3$ pascals, primarily due to the buffer gas, and the partial pressure of the ionizable discharge composition is about $1\times10^{-4}$ pascals. At steady state operating condition temperature of 100° C., the total pressure is about $1.370\times10^3$ pascals and the partial pressure of the ionizable discharge composition is about 1 pascal. In one embodiment, the lamp is a mercury lamp, where the discharge medium includes mercury. In another embodiment, the lamp is a mercury free lamp, where the discharge medium is mercury-free.

Figure 12:
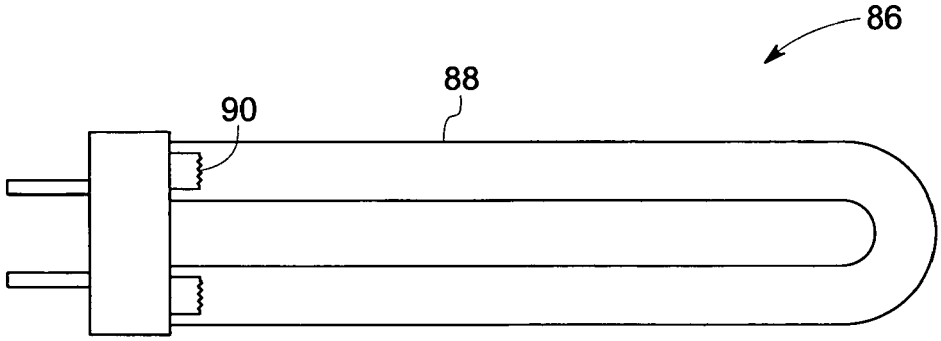
FIG. 12 is a top cross-sectional view of a circular fluorescent lamp employing an electron emissive material in accordance with embodiments of the present invention.
Figure 13:
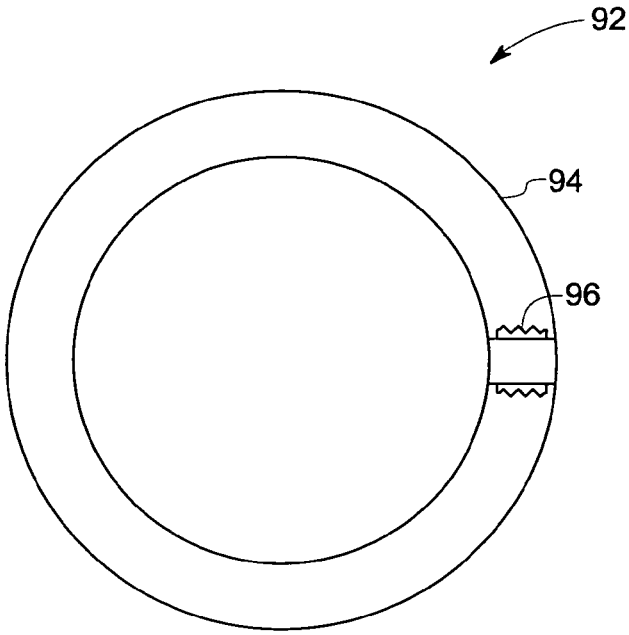
FIG. 13 is a side cross-sectional view of a high pressure fluorescent lamp employing an electron emissive material in accordance with embodiments of the present invention.
Figure 14:
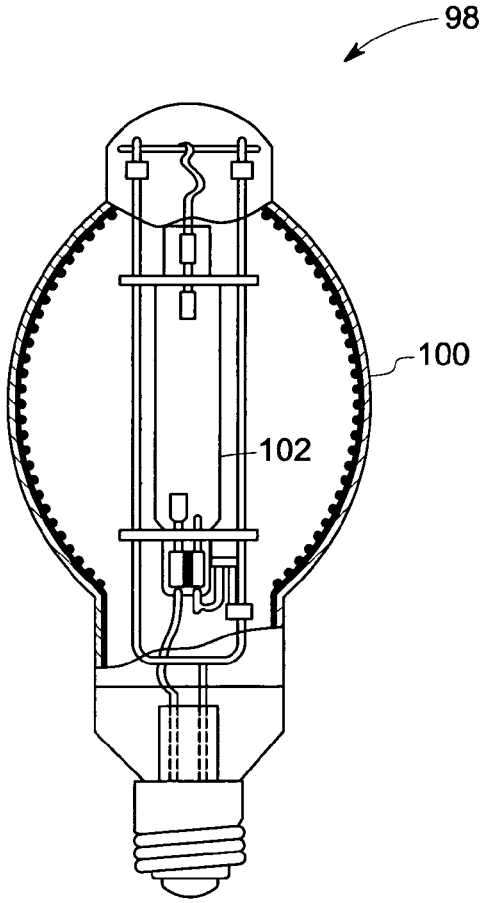
FIG. 14 is a side cross-sectional view of a high-pressure fluorescent lamp employing an electron emissive material in accordance with embodiments of the present invention.
Figure 15:
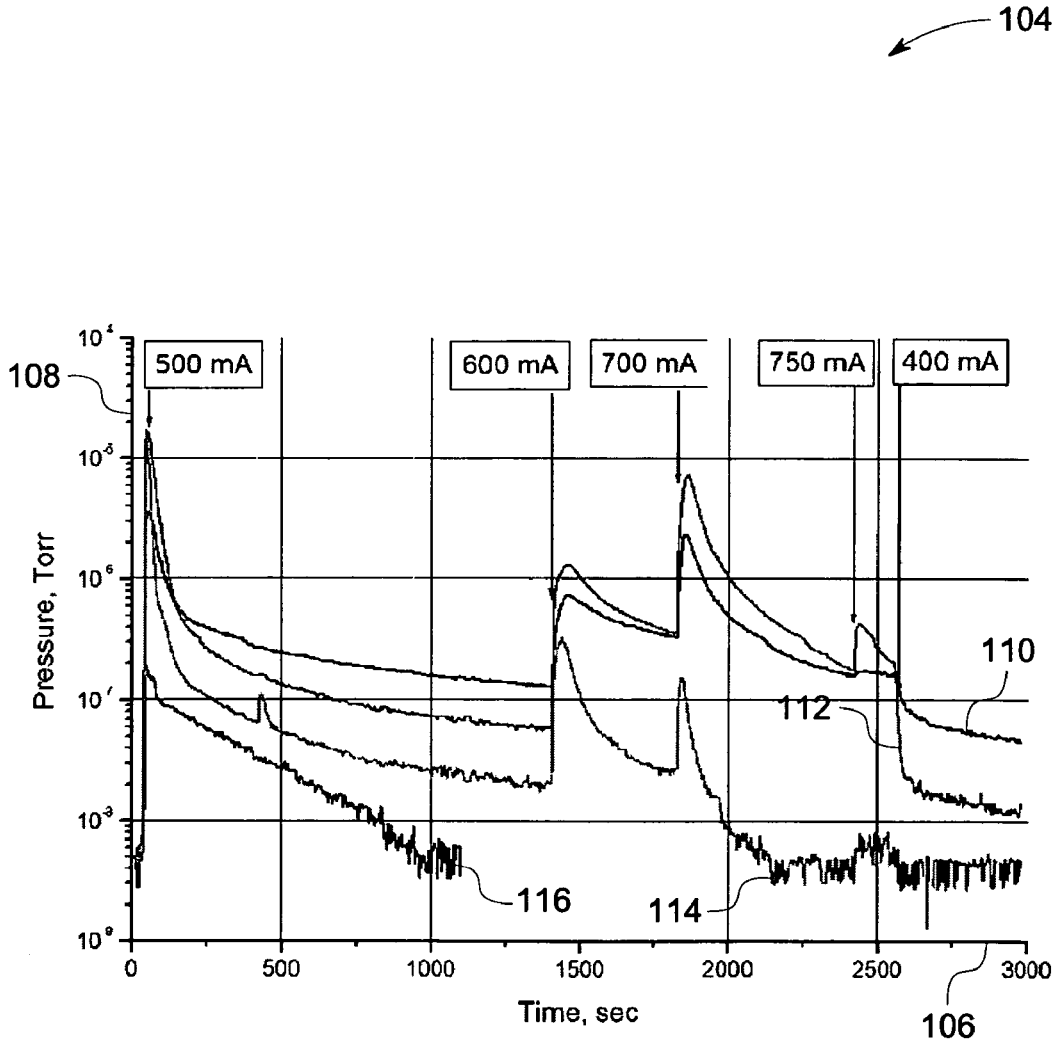
FIG. 15 is a graphical representation of an electron emissive material activation process in accordance with embodiments of the present invention.

In some embodiments, an electron emissive material may be provided in a fluorescent lamp including a cathode, a ballast, a discharge medium and an envelope or cover containing the discharge medium. The fluorescent lamp may comprise a linear fluorescent lamp 80 as illustrated in FIG. 12 with an envelope 82 and an electrode with the electron emissive material 84, or a compact fluorescent lamp 86 with an envelope 88 and an electrode with the electron emissive material 90 as illustrated in FIG. 13. The lamp may also be a circular fluorescent lamp 92 with an envelope 94 and an electrode with the electron emissive material 96, as illustrated in FIG. 14. Alternatively, the lamp may comprise a high-pressure lamp or high intensity discharge lamp 98, including an arc envelope 102 inside an outer housing 100 as illustrated in FIG. 15.

In some embodiments of the present invention, an electron emissive material disposed within a lamp is heated until it emits electrons, primarily by thermionic emission, but additional processes such as electric-field-enhanced emission may also contribute to electron emission. The heating may occur by any means, including electrical resistance heating of the substrate the electron emissive material is disposed over. Other ways of heating include heating due to discharge plasma in the lamp by means of processes such as but not limited to ion bombardment and ion recombination.

In accordance with still another embodiment of the present invention, a method of manufacturing an electron emissive system is described. The method includes blending a metal oxide composition with a binder to form a slurry, coating the slurry on a thermal or electrical excitation source or an electrode substrate such as a tungsten filament, and removing the binder. In a non-limiting example, the binder is removed by firing at a high temperature in an appropriate atmosphere at an optimized heating rate.

An electron emissive material may be manufactured by various processing methods utilized in the fields of ceramics and metallurgy, which generally permit good control over particle size and crystallinity. Suitable examples of such manufacturing processes are the reactive milling method, sol-gel method, wet chemical precipitation, molten-salt synthesis and mechano-chemical synthesis.

Metal compounds used in the preparation of a metal oxide composition may be ground up into the desired particle sizes using a combination of shear and compressive forces in devices such as ball mills, Henschel mixers, Waring blenders, roll mills, and the like. The metal compounds may be ground up for a time period effective to produce particles of about 0.4 to about 8 micrometers. In some embodiments, the particle size may be greater than or equal to about 0.8 micrometers. In other embodiments, the particle size may be greater than or equal to about 1 micrometer. In certain other embodiments, the particle size may be greater than or equal to about 1.5 micrometers. Other embodiments may include particles of size less than or equal to about 5 micrometers. Some other embodiments may include particles of size less than or equal to about 5 micrometers.

The powders of the precursor electron emissive material are generally first mechanically milled, if desired, to provide particles of a desired size. The particles are then blended with a binder and optionally a solvent to form a wet mixture. Mechanical milling may continue during the formation of the wet mixture. The wet mixture as may be a slurry, suspension, solution, paste, or the like. The wet mixture may be then coated onto a desired substrate, following which it is optionally allowed to dry to form a mechanically stable coating. In some embodiments, the mechanically stable coating may be a coating which generally has less than or equal to about 10 weight percent solvent based upon the weight of the wet mixture. In some embodiments, less than or equal to about 5 weight percent solvent may be present in the mechanically stable coating. In some other embodiments, less than 3 weight percent solvent may be present in the mechanically stable coating. In certain embodiments, less than or equal to about 2 weight percent solvent based on the total weight of the wet mixture may be present. The substrate with the mechanically stable coating may be annealed to facilitate the sintering of the coating to form the electron emissive material. In one embodiment, a composite comprising an electron emissive material can be disposed as a thin or a thick film on a tungsten substrate through a sol-gel process or other physical and/or chemical thin-film deposition methods.

Binders used in the preparation of the mixture typically are polymeric resins, ceramic binders, or combinations comprising polymeric resins and ceramic binders. Non-limiting examples of ceramic binders are aluminum phosphate ($AlPO_4$), silica ($SiO_2$), and magnesia (MgO). Polymeric resins used in the preparation of the wet mixture may be thermoplastic resins, thermosetting resins or combinations of thermoplastic resins with thermosetting resins. The thermoplastic resins may be oligomers, polymers, copolymers such as block copolymers, graft copolymers, random copolymers, star block copolymers, dendrimers, polyelectrolytes, ionomers or the like, or combinations comprising at least one of the foregoing thermoplastic resins. Suitable examples of thermoplastic resins are polyacetal, polyacrylic, styrene acrylonitrile, acrylonitrile-butadiene-styrene (ABS), polycarbonates, polystyrenes, polyethylene, polypropylenes, polyethylene terephthalate, polybutylene terephthalate, polyamides, polyamideimides, polyarylates, polyurethanes, polyetherimide, polytetrafluoroethylene, fluorinated ethylene propylene, perfluoroalkoxy polymers, polyethers such as polyethylene glycol, polypropylene glycol, or the like; polychlorotrifluoroethylene, polyvinylidene fluoride, polyvinyl fluoride, polyetherketone, polyether etherketone, polyether ketone ketone, nitrocellulose, cellulose, lignin, or the like, or combinations comprising at least one of the foregoing thermoplastic resins. In certain embodiments, thermoplastic resin may be nitrocellulose.

It is generally desirable to use thermoplastic resins having a number average molecular weight of about 1000 grams per mole (g/mole) to about 500,000 g/mole. Within this range, it may be desirable to use a thermoplastic resin having a number average molecular weight of greater than or equal to about 2,000. In certain embodiments, the number average molecular weight may be greater than or equal to about 3,000. In certain other embodiments, the number average molecular weight may be greater than or equal to about 4,000 g/mole. In some embodiments, the number average molecular weight may be less than or equal to about 200,000. In other embodiments, the number average molecular weight may be less than or equal to about 100,000. In still other embodiments, the number average molecular weight may be less than or equal to about 50,000 g/mole.

Examples of blends of thermoplastic resins include acrylonitrile-butadiene-styrene/nylon, polycarbonate/acrylonitrile-butadiene-styrene, acrylonitrile butadiene styrene/polyvinyl chloride, polyphenylene ether/polystyrene, polyphenylene ether/nylon, polycarbonate/thermoplastic urethane, polycarbonate/polyethylene terephthalate, polycarbonate/polybutylene terephthalate, polyethylene terephthalate/polybutylene terephthalate, styrene-maleic anhydride/acrylonitrile-butadiene-styrene, polyethylene/nylon, polyethylene/polyacetal, or the like, or combinations comprising at least one of the foregoing blends of thermoplastic resins.

Specific non-limiting examples of polymeric thermosetting materials include polyurethanes, epoxy, phenolic, polyesters, polyamides, silicones, or the like, or combinations comprising at least one of the foregoing thermosetting resins.

Ceramic binders may also be used in the preparation of the wet mixture. Examples of ceramic binders are aluminum phosphate, zirconia, zirconium phosphate, silica, magnesia and the like. In some embodiments, binders may be used in an amount of about 5 weight percent, to about 50 weight percent based on the total weight of the wet mixture. In certain embodiments, binders may be generally present in the wet mixture in an amount of greater than or equal to about 8 weight percent. In other embodiments, binders may be present in an amount greater than or equal to about 10 weight percent. In still other embodiments, binder may be present in an amount greater than or equal to about 12 weight percent based on the total weight of the wet mixture. Some other embodiments, include binders present in the wet mixture in an amount of less than or equal to about 45 weight percent. In certain embodiments, binders may be present in an amount less than or equal to about 40 weight percent. In yet other embodiments, binders may be present in an amount less than or equal to about 35 weight percent based on the total weight of the wet mixture.

Solvents may optionally be used in the preparation of the wet mixture. Liquid aprotic polar solvents such as propylene carbonate, ethylene carbonate, butyrolactone, acetone, acetonitrile, benzonitrile, nitromethane, nitrobenzene, sulfolane, dimethylformamide, N-methylpyrrolidone, butyl acetate, amyl acetate, methyl propanol or propylene glycol monomethyl ether acetate with denatured ethanol, or the like, or combinations comprising at least one of the foregoing solvents may generally be used in the preparation of the wet mixture. Polar protic solvents such as water, methanol, acetonitrile, nitromethane, ethanol, propanol, isopropanol, butanol, or the like, or combinations comprising at least one of the foregoing polar protic solvents may also be used in the preparation of the wet mixture. Other non-polar solvents such a benzene, toluene, methylene chloride, carbon tetrachloride, hexane, diethyl ether, tetrahydrofuran, or the like, or combinations comprising at least one of the foregoing solvents may also be used in the preparation of the wet mixture. Co-solvents comprising at least one aprotic polar solvent and at least one non-polar solvent may also be utilized to prepare the wet mixture. Ionic liquids may also be utilized for preparing the wet mixture. In some embodiments, the solvent may be bepropylene glycol mono-methyl ether acetate with denatured ethanol. In a non-limiting example, the solvent comprises about 90 weight percent to about 95 weight percent of propylene glycol mono-methyl ether acetate with about 1 weight percent to about 2 weight percent of the denatured alcohol.

The solvent is generally used in an amount of about 5 weight percent to about 60 weight percent based on the total weight of the wet mixture. Within this range, the solvent is generally present in the wet mixture in an amount of greater than or equal to about 8 weight percent. In some embodiments, the solvent may be present in an amount greater than or equal to about 10 weight percent. In other embodiments, the solvent is present in an amount greater than or equal to about 12 weight percent based on the total weight of the wet mixture. Within this range, the solvent may be generally present in the wet mixture in an amount of less than or equal to about 48 weight percent. In some embodiments, the solvent may be present in an amount less than or equal to about 45 weight percent. In certain embodiments, the solvent may be present in an amount less than or equal to about 40 weight percent based on the total weight of the wet mixture.

The wet mixture may be generally coated onto a desired substrate such as a tungsten wire or sheet and then sintered to form a coating. The coating of the substrate may be carried out by processes such as dip coating, spray painting, electrostatic painting, painting with a brush, or the like. In one embodiment, an electron emissive material coating thickness may be from about 3 micrometers to about 100 micrometers after sintering. In another embodiment, the coating thickness may be from about 10 micrometers to about 80 nanometers. In a still another embodiment, the coating thickness may be from about 15 micrometers to about 60 micrometers.

The coated substrate may be generally subjected to a sintering process to remove the solvent and binder and to form a coating of the electron emissive material on the substrate. The sintering process may be conducted by heating process such as conduction, convection, radiation such as radio frequency radiation or microwave radiation. In another embodiment, the electrode may be resistively heated to sinter the wet mixture to form the electron emissive material. Combinations of different methods of heating for purposes of sintering, such as, for example, convective heating in combination with resistive heating may also be used if desired. The sintering process by conduction, convection, radiation, resistive heating or combinations thereof may be carried out at a temperature of about 1000° C. In certain embodiments of the present invention, the sintering may be conducted in a two-stage process if desired. In the first stage the binder may be eliminated by heating the mechanically stable coating to a temperature of about 300° C. to about 400° C. for about 10 to about 60 minutes. In the second stage the material may be sintered to a temperature of about 1000° C. to about 1700° C.

In a further embodiment, the electron emissive material coated on a substrate may be subjected to an activation process. The activation process is typically carried out by heating the substrate with the coating through a sequence of successively higher temperatures. In certain embodiments, the activation process may reduce the material, and create a semi conducting state of the material. For example, if the activation process results in oxygen deficiency in the material, such that excess metal is present in the metal oxide composition, the excess metal may act as dopant and lead to increased electrical conductivity. In a non-limiting example, an electrode with the coating may be disposed on a mount, and the mount may be sealed into the ends of a lamp tube, the gas inside the tube is removed by a vacuum pump through a tubulation, the electrodes are heated through a time-temperature schedule while continuing to pump away the reaction products of chemical decomposition. In some embodiments, the time-temperature schedule might include further steps to do the activation or reduction to the semiconducting state. The dosing material may then be added into the volume (rare-gas, solid pills, liquid drops, etc), and the tubulation is sealed to create a hermetic lamp tube. During this whole time the tube may be heated to drive water and other impurities off the walls. The decomposition-activation steps may be done in vacuum tubes.

The substrate may have any desired shape. It may be 1-dimensional, 2-dimensional or 3-dimensional or any suitable fractional dimension up to about 3. Suitable examples of 1 dimensional substrate are linear filaments, non-linear filaments such as circular filaments, elliptical filaments, coiled filaments or the like. Suitable examples of 2-dimensional substrates are flat plates, flat or curved sheets, and the like. Suitable examples of 3-dimensional substrates are hollow spheres, cups, beads, and the like. It may also be possible to use substrates having a combination of 1, 2, or 3-dimensional geometries. Non-limiting example of a substrate is a tungsten filament. In one embodiment, the substrate may be an electrode in a lamp. The electrode may be an anode, a cathode, or both an anode and a cathode in a lamp.

In another embodiment, a metal oxide composition and tungsten powder may be sintered to a high density and used as a composite sintered electrode. Such a composite sintered electrode may desirably offer significant flexibility in the positioning of the cathode within the lamp and allows lamp design flexibility such as fluorescent tubes of narrower diameter.

In some embodiments, providing an electron emissive material includes providing an impregnated electrode. The electron emissive material may be embedded into the pores of a porous refractory metal such as tungsten or tantalum.

In yet a further embodiment of the present invention a method for operating a lamp. The method may include thermally or electrically exciting an electron emissive material including a metal oxide composition disposed within a lamp, by operably coupling the lamp to an excitation source such as an electrode substrate and supplying thermal or electrical energy to cause the electron emissive material to emit electrons. A non-limiting example of how an excitation source energized may be by coupling to an alternating current (AC) or direct current (DC) power supply. In a non-limiting example, a neodymium oxide electron emissive material may be used in an indium iodide discharge material lamp.

Due at least in part to the nature of the various compositions described herein, degradation of metal halide discharge materials in metal halide lamps due to interactions with electron emissive materials, can be reduced or altogether avoided. The compositions in accordance with embodiments of the present invention are stable in the presence of halogen vapor. Further, the compositions may also be environmentally less toxic compared with other compositions such as thorium oxide (radioactive), which may also be stable in halogen vapor.

Without further elaboration, it is believed that one skilled in the art can, using the description herein, utilize the present invention to its fullest extent. The following examples are included to provide additional guidance in practicing the claimed invention. The examples provided are merely representative of the work that contributes to the teaching of the present application. Accordingly, these examples are not intended to limit the invention, as defined in the appended claims, in any manner.

EXAMPLE 1

A neodymium oxide electron emissive material was prepared in accordance with one embodiment of the present invention. Neodymium oxide, a binder comprising about 4.4 weight percent of nitrocellulose in ethylene acetate, and a solvent, acetone, were provided. In one example, weight ratio of (neodymium oxide):binder:acetone was 100:109:250. For application on a single electrode, about 1 to about 5 milligrams of neodymium oxide was used.

The neodymium oxide, the binder and the acetone solvent were placed into an agitator to form a homogenous mixture. Examples of agitators include ultrasonic baths and magnetic stirrers. The solution was agitated until no aggregate particles or clusters were seen in the mixture.

In one example, the homogenous mixture was painted on a bare tungsten coil substrate, using a small paintbrush to form a coating of the electron emissive material. In another example, the solution was applied on an electrode substrate by immersing the entire substrate into the homogenous mixture and removing it after a few seconds to form a coating of the electron emissive material. After the coating was formed on the tungsten coil, the entire electrode was left in an enclosed box, which had continuous pure nitrogen purge flowing through the enclosure. During the drying process, this allowed the electrode to be dried without the possibility of absorbing water vapor from the atmosphere. It may also be possible to perform the drying process in a flowing gas containing heated (~60° C.) atmospheric air. The resultant coating resembled a powder-like coating. Upon drying, the electrode was ready for activation.

One example of an activation process is a purely thermal activation process, where an electrode including a substrate with a coating of an electron emissive material, is heated through a sequence of successively higher temperatures by passing current through the substrate. FIG. 15 is a graphical illustration of the activation process demonstrating reduction in impurity concentrations of a tungsten coil substrate with a coating of an electron emissive material in accordance with one embodiment of the present invention. During the process of heating the electrode, various condensable substances and trapped impurity gases were released as can be seen in a time 106 vs. partial pressure of impurity gases released 108 plot 104. As the current was raised the temperature of the electrode increased to a temperature in a range from about 900K and about 1700K. A gas analysis of the gaseous environment surrounding the electrode, as illustrated in FIG. 15, shows the partial pressure of various gases released, such as hydrogen 110, carbon monoxide 112, carbon dioxide 114, and water 116, as the current was increased from 400 mA to 750 mA during the thermal activation process. At the end of this process, the electrode was ready for use in driving a discharge as a cathode.

EXAMPLE 2

Figure 16:
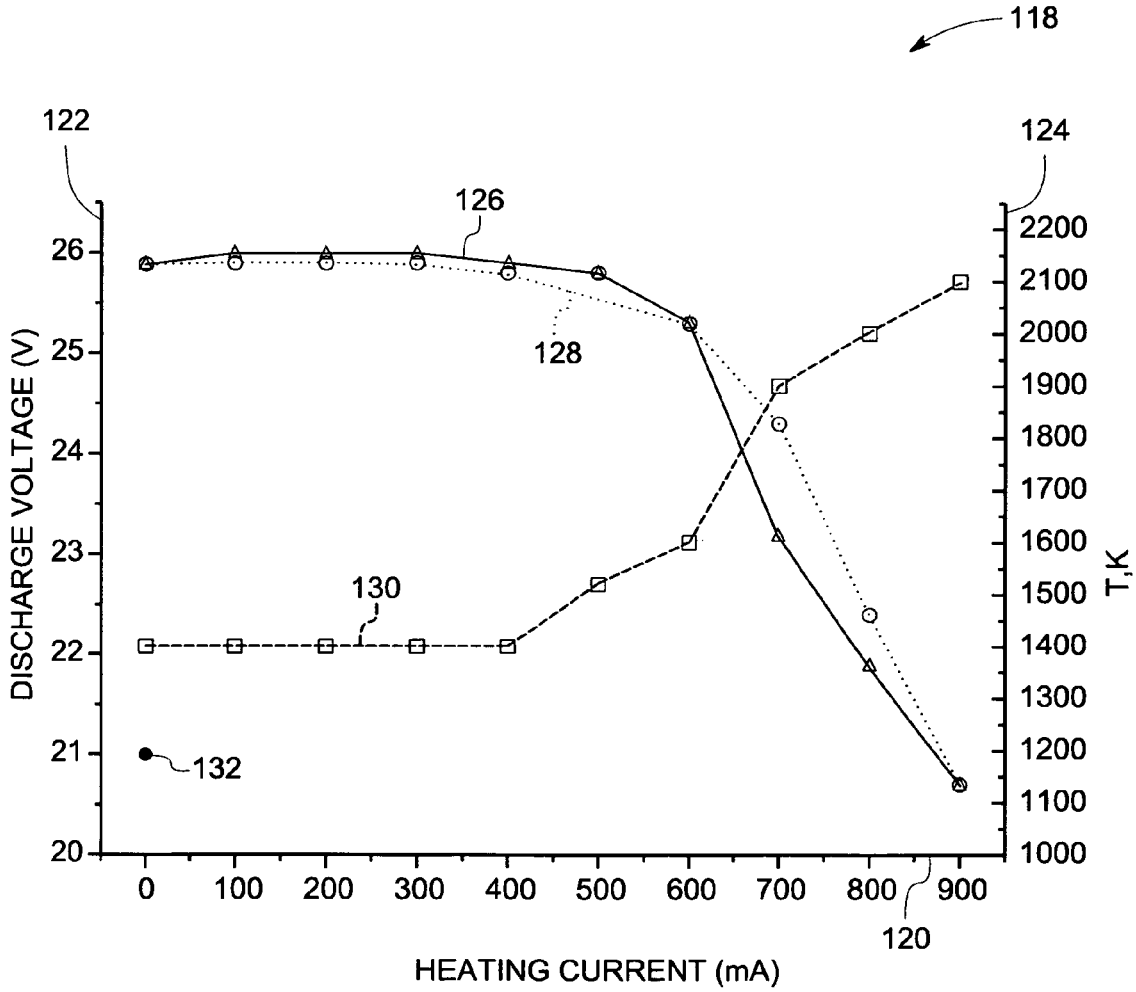
FIG. 16 is a graphical representation of discharge voltage and hot spot temperature versus external heating current in accordance with embodiments of the present invention.

In accordance with one embodiment of the present invention, an electron emissive material including neodymium oxide was coated on a tungsten coil substrate to form an electrode. The electron emissive material was activated by external heating of the electrode for about 0.5 hours with about 900 mA current, the electrode reaching a temperature of about 1850 K during the activation process. The activated electrode was used in an argon discharge lamp. FIG. 16 illustrates the dependence of discharge voltage 122 and hot spot temperature 124 versus heating current 120 at an argon discharge pressure of about 427 pascals. Line 126 shows the variation in discharge voltage when a current flowing through the cathode was increased from about 0 mA to about 900 mA and line 128 shows the variation in discharge voltage when the current was reduced from about 900 mA to about 0 mA. Line 130 shows the variation in hot spot temperature on increase of heating current. Point 132 indicates the discharge voltage at zero heating current for a conventional barium-strontium-calcium triple oxide electron emissive material disposed on a tungsten coil substrate. It can be seen that at heating currents of about 900 mA, the discharge voltage with a neodymium oxide electron emissive material is about the same as for a triple oxide electron emissive material at zero heating current.

Figure 17:
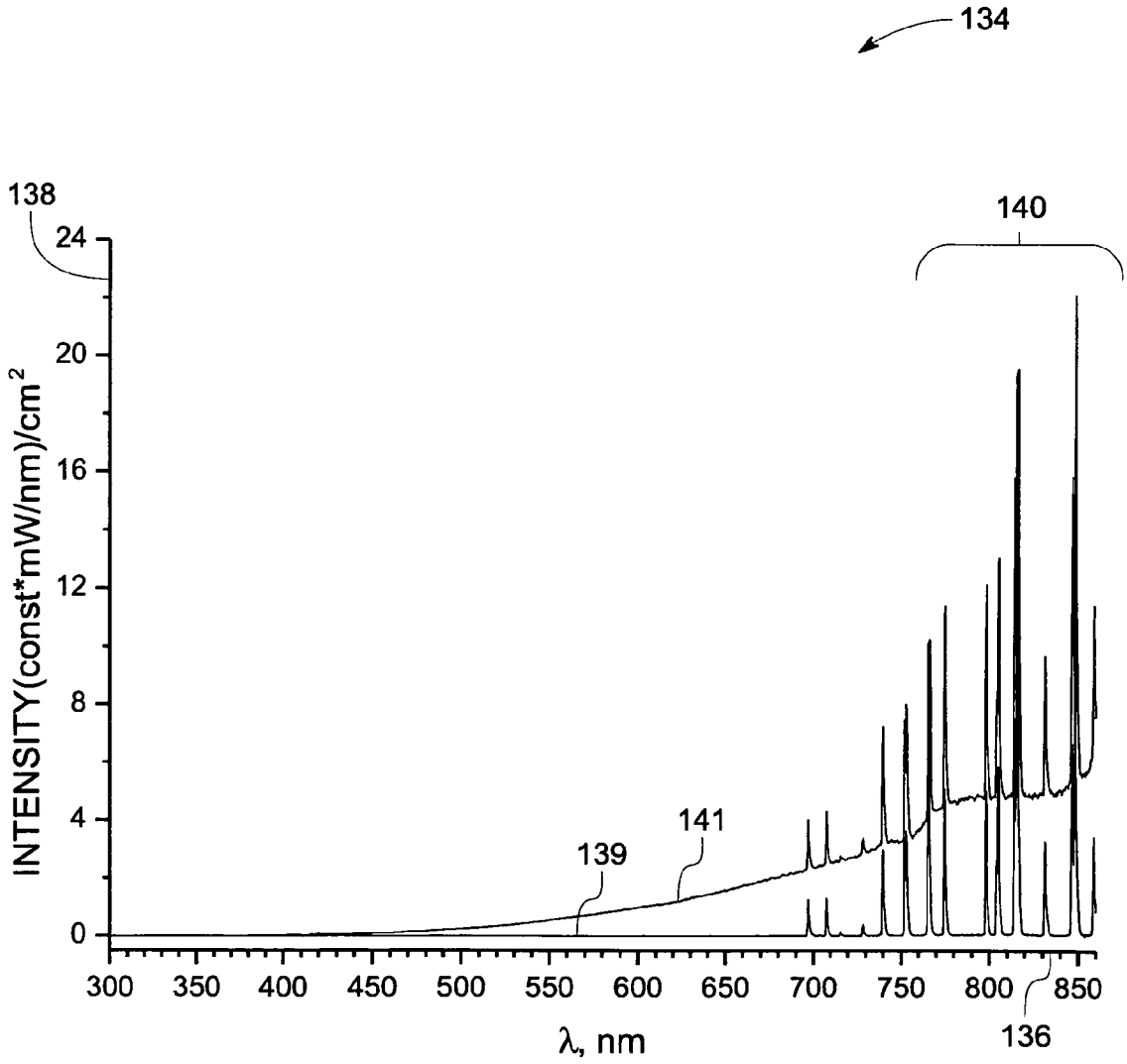
FIG. 17 is a graphical representation of an emission spectra of a discharge lamp in accordance with embodiments of the present invention.

FIG. 17 is a graphical illustration of the argon discharge spectrum in an argon lamp with a cathode with a lutetium oxide electron emissive material. Plot 134 is a wavelength 136 versus intensity 138 plot of the argon discharge at an argon pressure of 427 Pascals, using the cathode with a lutetium oxide electron emissive material in accordance with one embodiment of the present invention. Line 139 is a spectrum of the argon discharge measured at a hot spot on the electrode at zero heating current at a discharge voltage of about 26.4 Volts at a hot spot temperature of about 1400 degree K. Line 141 is a spectrum of the argon discharge at the hot spot on the cathode at about 900 mA heating current at a discharge voltage of about 21.2 volts at a hot spot temperature of about 2100 degree K. The increased background intensity shown in line 139 is an indication of the additional energy supplied to the cathode in the form of the external heating current. The argon discharge intensity peaks 140 are found in the near infrared wavelength region.

EXAMPLE 3

Figure 18:
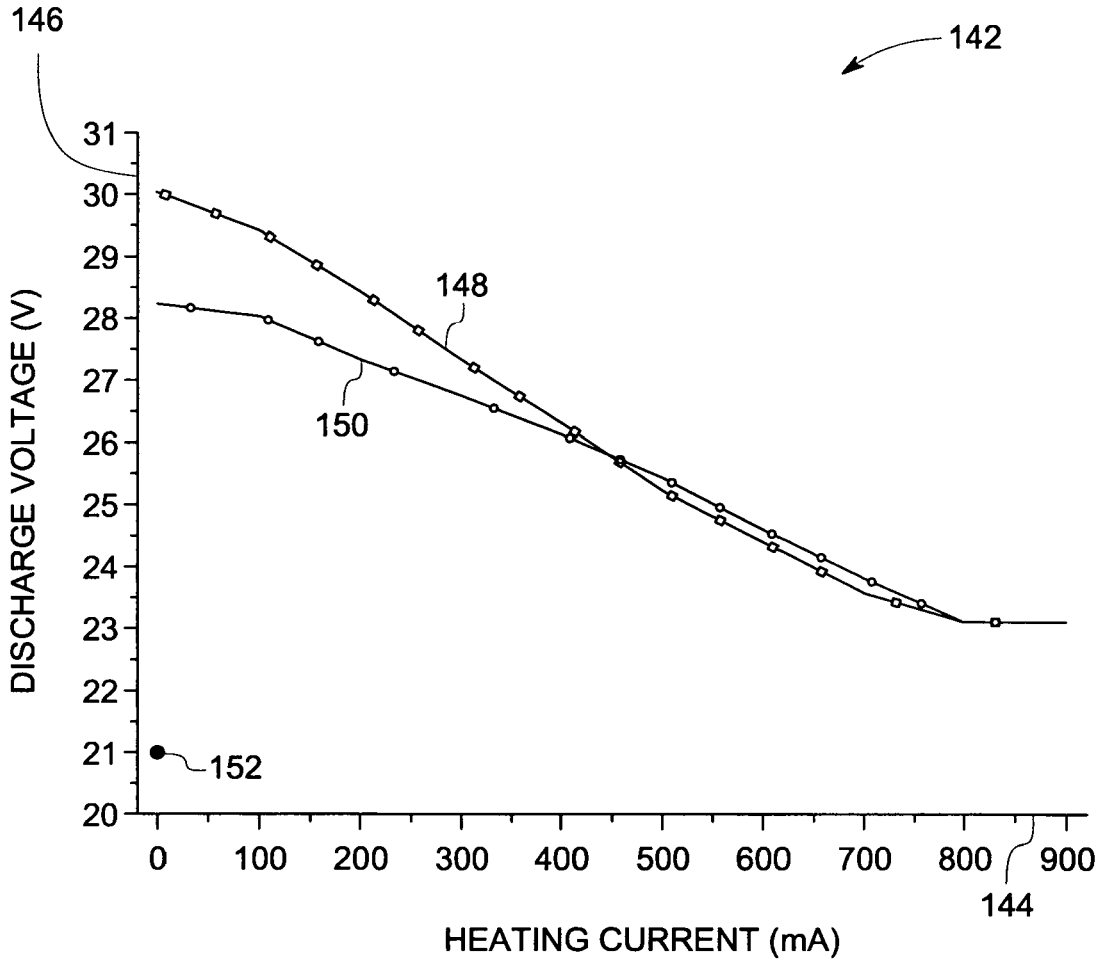
FIG. 18 is a graphical representation of discharge voltage versus external heating current in accordance with embodiments of the present invention.

An electrode including a lutetium oxide electron emissive material coating was used to ignite and maintain an argon discharge in a lamp. The dependence of the discharge voltage 146 with current 144 is shown in plot 142 (FIG. 18). Line 148 shows the variation in discharge voltage when a heating current flowing through the electrode was increased from about 0 mA to about 900 mA and line 150 shows the variation in discharge voltage when the current was decreased from about 900 mA to 0 mA. Line 148 and 150 show good overlap indicating good reproducibility in the discharge voltage with increase and decrease of heating current. Point 152 indicates the discharge voltage at zero heating current for a conventional barium-strontium-calcium triple oxide electron emissive material disposed on a tungsten coil substrate. It can be seen that at heating currents of about 900 mA, the discharge voltage with a lutetium oxide electron emissive material is within 15% of the discharge voltage of a barium-strontium-calcium triple oxide electron emissive material at zero heating current.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. An electrode comprising an electron emissive material, wherein the electron emissive material comprises a composition comprising at least one metal oxide selected from the group consisting of oxides of La, Ce, Pr, Nd, Pm, Sm, Eu, Gd, Tb, Dy, Ho, Er, Tm, Yb, Lu, Y, Sc, Hf, Zr, and combinations thereof, wherein the metal oxide is present in a quantity that ranges from about 20% to 100% by weight of the total electron emissive material, wherein the electron emissive material is barium-free, wherein the discharge medium under steady state operating conditions producing a total vapor pressure of less than about $2\times10^5$ Pa.

2. The electrode of claim 1, wherein the discharge medium under steady state operating conditions producing a total vapor pressure of less than about $2\times10^4$ Pa if excited.

3. The electrode of claim 1, wherein the composition comprises at least one metal oxide selected from the group consisting of neodymium oxide, terbium oxide, lutetium oxide and combinations thereof.

4. The electrode of claim 1, wherein the electron emissive material further comprises at least one additive material selected from the group consisting of zirconium, calcium oxide, strontium oxide, magnesium oxide and combinations thereof.

5. The electrode of claim 1, wherein the electron emissive material is disposed as a coating on a planar tungsten foil or a tungsten filament.

6. The electrode of claim 1, further comprising a tungsten coil wrapped around a core structure including the electron emissive material.

7. A lamp comprising:

an envelope;

an electrode, wherein the electrode comprises an electron emissive material, operable to emit electrons in response to a thermal excitation, comprising at least one oxide selected from the group consisting of oxides of La, Ce, Pr, Nd, Pm, Sm, Eu, Gd, Tb, Dy, Ho, Er, Tm, Yb, Lu, Y, Sc, Hf, Zr, and combinations thereof, wherein the metal oxide is present in a quantity that ranges from about 20% to 100% by weight of the total composition, wherein the electron emissive material is barium-free; and a discharge medium contained within the envelope, wherein said discharge medium under steady state operating conditions producing a total vapor pressure less than about $2\times10^5$ Pa.

8. The lamp of claim 7, wherein said discharge medium, under normal operation conditions, excluding any buffer gas producing a total vapor pressure less than about $2\times10^4$ Pa.

9. The lamp of claim 7, wherein said discharge medium under normal operation conditions producing a total vapor pressure less than about $2\times10^4$ Pa.

10. The lamp of claim 9, wherein said discharge medium excluding any buffer gas under normal operation conditions producing a total vapor pressure of about $2\times10^3$ Pa.

11. The lamp of claim 7, wherein the composition comprises at least one metal oxide selected from the group consisting of neodymium oxide, terbium oxide, lutetium oxide and combinations thereof.

12. The lamp of claim 7, wherein the discharge medium comprises at least one material selected from the group consisting of Hg, Na, Zn, Mn, Ni, Cu, Al, Ga, In, Tl, Sn, Pb, Bi, Ti, V, Cr, Zr, Nb, Mo, Hf, Ta, W, Re, Os and combinations thereof.

13. The lamp of claim 7, wherein the discharge medium comprises at least one material selected from the group consisting of helium, neon, argon, krypton, xenon, and combinations thereof.

14. The lamp of claim 7, wherein the discharge medium comprises a compound of at least one metal selected from the group consisting of Hg, Na, Zn, Mn, Ni, Cu, Al, Ga, In, Tl, Ge, Sn, Pb, Bi, Ti, V, Cr, Zr, Nb, Mo, Hf, Ta, W, Re, Os, and combinations thereof.

15. The lamp of claim 14, wherein said compound comprises at least one of a halide, an oxide, a chalcogenide, a hydroxide, a hydride, and an organometallic compound.

16. The lamp of claim 7, where in the discharge medium comprises at least one material selected from the group consisting of gallium iodide, zinc iodide and indium iodide.

17. The lamp of claim 7, wherein the discharge medium comprises gallium iodide and the composition comprises at least one material selected from the group consisting of neodymium oxide, terbium oxide, zirconium oxide, dysprosium oxide and combinations thereof.

18. The lamp of claim 7, wherein the lamp comprises one selected from the group consisting of a linear fluorescent lamp, compact fluorescent lamp, a circular fluorescent lamp, a high intensity discharge lamp, a flat panel display, a mercury free lamp and a xenon lamp.

* * * * *